US012234068B2

(12) United States Patent
Enemark et al.

(10) Patent No.: US 12,234,068 B2
(45) Date of Patent: Feb. 25, 2025

(54) CLOSURE DEVICE FOR ASEPTIC LIQUID CONTAINING CONTAINERS

(71) Applicant: Elopak GmbH, Mannheim (DE)

(72) Inventors: Frode Enemark, Silkeborg (DK); Sebastian Lauhof, Gross Schwulper (DE)

(73) Assignee: Elopak ASA, Spikkestad (NO)

( * ) Notice: Subject to any disclaimer, the term of this patent is extended or adjusted under 35 U.S.C. 154(b) by 102 days.

(21) Appl. No.: 17/791,914

(22) PCT Filed: Jan. 26, 2021

(86) PCT No.: PCT/EP2021/051739
§ 371 (c)(1),
(2) Date: Jul. 11, 2022

(87) PCT Pub. No.: WO2021/151882
PCT Pub. Date: Aug. 5, 2021

(65) Prior Publication Data

US 2023/0091799 A1 Mar. 23, 2023

(30) Foreign Application Priority Data

Jan. 27, 2020 (EP) ..... 20153936
Oct. 26, 2020 (EP) ..... 20203931

(51) Int. Cl.
*B65D 5/74* (2006.01)
*B65D 41/34* (2006.01)
*B65D 55/16* (2006.01)

(52) U.S. Cl.
CPC ..... *B65D 5/746* (2013.01); *B65D 5/747* (2013.01); *B65D 41/3447* (2013.01); *B65D 55/16* (2013.01); *B65D 2401/30* (2020.05)

(58) Field of Classification Search
CPC .... B65D 5/746; B65D 5/747; B65D 41/3447; B65D 55/16; B65D 2401/30
See application file for complete search history.

(56) References Cited

U.S. PATENT DOCUMENTS 5,141,133 A * 8/1992 Ninomiya ..... B67B 7/26 222/541.2
6,223,924 B1 * 5/2001 Ek ..... B65D 5/748 215/230

(Continued)

FOREIGN PATENT DOCUMENTS

DE 102010028518 11/2011
DE 202019106993 U1 * 3/2020 ..... B65D 5/74

(Continued)

OTHER PUBLICATIONS

Third party observations in application 20153936.8.

(Continued)

*Primary Examiner* — Paul R Durand
*Assistant Examiner* — Michael J. Melaragno
(74) *Attorney, Agent, or Firm* — Christian D. Abel

(57) ABSTRACT

The present invention relates to a closure device for aseptic paper or paper-based containers which can be used for storing liquid products. In particular, the present invention relates to a closure device comprising three parts. It has a pour spout which can be fixed to an outer surface of the container, a cap having a re-sealable lid portion being permanently connected to a retainment portion via a hinge and a barrier breaking device moveably attached to the pour spout and configured to break a liquid tight seal of the paper or paper-based container upon twisting said cap. The invention also relates to an assembly comprising a container and said closure device and a method for providing the assembly.

17 Claims, 10 Drawing Sheets

(56) References Cited

U.S. PATENT DOCUMENTS

| | | | | |
|---|---|---|---|---|
| 7,841,484 | B2 * | 11/2010 | Kaneko | B65D 5/748 408/206 |
| 10,676,261 | B2 * | 6/2020 | Berge | B65D 5/748 |
| 2009/0277859 | A1 | 11/2009 | Von Spreckelsen et al. | |
| 2012/0285921 | A1 * | 11/2012 | Kwon | B65D 55/16 215/243 |
| 2012/0298666 | A1 * | 11/2012 | Kwon | B29C 45/44 220/268 |
| 2015/0251827 | A1 * | 9/2015 | Campbell | B65D 55/16 215/258 |
| 2023/0025075 | A1 * | 1/2023 | Leuenberger | B65D 55/024 |
| 2023/0048599 | A1 * | 2/2023 | Enemark | B65D 55/16 |
| 2023/0091799 | A1 * | 3/2023 | Enemark | B65D 5/746 222/81 |

FOREIGN PATENT DOCUMENTS

| | | | | |
|---|---|---|---|---|
| DE | 202019106993 | | 5/2020 | |
| DE | 202020100758 | U1 * | 5/2020 | B65D 1/0246 |
| EP | 1088764 | | 4/2001 | |
| EP | 3715274 | | 9/2020 | |
| EP | 3854716 | A1 * | 7/2021 | B65D 41/3447 |
| FR | 1190251 | | 10/1959 | |
| JP | 2009220889 | | 10/2009 | |
| JP | 2011-219112 | | 11/2011 | |
| JP | 2019-85126 | | 6/2019 | |
| JP | 2019534218 | | 11/2019 | |
| WO | 2009001986 | | 12/2008 | |
| WO | 2010106327 | | 9/2010 | |
| WO | 2014200165 | | 12/2014 | |
| WO | 2019238988 | | 12/2019 | |
| WO | WO-2020099200 | A1 * | 5/2020 | B65D 1/0246 |
| WO | 2020/212430 | | 10/2020 | |

OTHER PUBLICATIONS

Third Party Observations to Rule 114(2)EPC in EP application 20203931.9.
EESR for EP2015393.8 submitted inter alia as a statement of relevance for any non-English references cited therein.
EESR for EP2020393.9 submitted inter alia as a statement of relevance for any non-English references cited therein.
ISR and WOISA for PCT/EP2021/051737 submitted inter alia as a statement of relevance for any non-English references cited therein.
ISR and WOISA for PCT/EP2021/051739 submitted inter alia as a statement of relevance for any non-English references cited therein.
Office Action from JP Patent Office of Oct. 9, 2024.
Translation of JP office action.

* cited by examiner

CLOSURE DEVICE FOR ASEPTIC LIQUID CONTAINING CONTAINERS

TECHNICAL FIELD

The present invention relates to a closure device for aseptic paper or paper-based containers which can be used for storing liquid products. In particular, the present invention relates to a closure device comprising three parts. It has a pour spout which can be fixed to an outer surface of the container, a cap having a re-sealable lid portion being permanently connected to a retainment portion via a hinge and a barrier breaking device moveably attached to the pour spout and configured to break a liquid tight seal/barrier of the paper or paper-based container upon twisting said cap.

The invention also relates to an assembly comprising an aseptic container and said closure device and a method for providing the assembly. In particular, the present invention relates to such an assembly wherein the container comprises a paper or paper-based packaging. A paper-based packaging is sometimes referred to as a "carton" and is commonly used to distribute liquid consumable products, e.g. dairy products, such as milk, or fruit juices.

BACKGROUND OF THE INVENTION

For cartons for sensitive food products, such as milk or juice, it is important that the closure device is thoroughly sealable to be clean and sanitary and yet be functional from the standpoint of readily opening and closing the pour spout thereof.

A container or carton is typically produced from a laminate packaging material, which typically comprises a multiply paper or paperboard sheet on which is laminated by one or a plurality of barrier layers for holding the liquid and/or prevent migration of air and flavour degrading substances through the paperboard. A barrier layer may typically comprise a polyethylene or an aluminium layer.

The pour spout of the closure device can be attached to a location on the outer surface of the carton wherein a barrier on the carton is located that can be broken by a barrier breaking element on the closure device when opening the closure device for the first time.

U.S. Pat. No. 6,851,576 B2 discloses a closure device wherein a barrier breaking element/piercing element is moved helically towards the barrier which causes the barrier to be folded away from the pour spout allowing liquid to be poured from the carton into the pour spout.

WO 2010/109155 A1 and WO 2010/128302 A1 also disclose a closure device having a turnable cutting device in the pour spout whereby a hole can be formed through a zone of a wall of the carton permitting pouring of liquid of the carton from the pour spout.

A disadvantage of these closure devices known from prior art is that the screw cap is removed from the closure device after opening the pour spout opening for pouring liquid out of the carton enhancing the risk for users misplacing or losing the cap.

Closure devices wherein a screw cap is retained to the closure device after opening the pour spout for pouring liquid out of the carton is known in the art which prevents users from misplacing and losing the lid portion when operating the carton, e.g. when pouring liquid from the carton.

US 2012/298,666 A1 discloses a stopper/hinge closure device for a packaging container having a long neck portion. The stopper includes bridges for checking whether a screw-coupling type stopper is opened or not and a hinge portion where an inner concave groove is formed, thereby enabling the connection of a stopper body/lid and a fixing ring for maintaining a set opening angle of the stopper body in case of opening, to thus prevent the stopper body from drooping and being shaken, and thereby elastically carrying out opening and closing operations.

U.S. Pat. No. 6,474,491 B1 discloses a closure device comprising a cap which includes a ring held axially on that part of the container which delimits the opening of this container, and two arms in the form of an arc of a circle, each of which is connected to the cap on the one hand, by means of a film hinge and parts that are able to fold, and to the ring on the other hand. These arms allow the cap to be tilted outwards with respect to the container so as to be released from the opening of the container, however the arms being thin and easily damaged or deformed. The complex structure of the closure device makes the manufacturing comprehensive.

However, such closure devices wherein the screw cap is retained to the closure device after opening the closure device are not suitable for aseptic liquid containing containers as a barrier of the carton cannot be opened by the closure device.

A first object of the present invention is to provide a closure device for an aseptic container wherein all parts are connected and/or interactively connected after opening the closure for the first time.

A second object of the invention is to provide a closure device that indicates to a consumer whether the closure device has been previously opened which may indicate that the product within the container can be contaminated.

A third object of the invention is to provide a liquid tight closure device which is easy to open and close being less susceptible to damage and/or deformation.

A fourth object of the invention to provide a closure device which is simple and economical to manufacture.

A fifth object of the present invention to provide a closure device which when in an open position, does not interfere with the pouring operation.

A sixth object of the invention is to provide a closure device which is easy to use by having an improved opening and closing functionality compared to prior art.

SUMMARY OF THE INVENTION

The present invention provides a liquid tight hinged closure device for an aseptic paper or paperboard-based container which is possible to rotate/twist and flip open making it consumer friendly.

According to an example aspect the present invention provides a closure device comprising three parts, a pour spout, a cap and a barrier breaking element.

The pour spout comprises:

- a longitudinal centre axis defining an axial direction z, a circumferential direction c and a radial direction r of the pour spout,
- an annular longitudinal neck portion extending along the axial direction z from a first axial end to a second axial end defining a dispensing opening, the neck portion further comprising an internal first thread for interacting with the barrier breaking element and an external second thread for interacting with the cap and
- an annular flange portion for attaching/fixing the closure device to the container, the annular flange portion extending in the radial direction r outwardly from the second axial end of the neck portion.

The cap comprises:

an annular tamper-evident band being retained around said neck portion, a retainment portion being rotatably retained around said neck portion, a lid portion comprising an annular longitudinal skirt having an internal ramp configured to interact with said external second thread of the pour spout, a hinge portion having a pivot axis about which the lid portion is configured to be pivotally movable relative to the retainment portion, the hinge portion permanently connecting the annular skirt of the lid portion to the retainment portion along a predefined circumferential extent, a first rupturable section along which the tamper-evident band is configured to be connected to the retainment portion prior to a first opening of the closure device, the first rupturable section being configured to break during the first opening and a second rupturable section along which the lid portion is configured to be connected to the retainment portion prior to the first opening, which second rupturable section is configured to break during the first opening;

wherein the lid portion is configured to be operable between a first position in which the lid portion sealingly covers said dispensing opening, a second position in which the lid portion non-sealingly covers the dispensing opening, and a third position in which the lid portion is located at least partly at a side of the dispensing opening.

The barrier breaking element comprises:

an external third thread configured to interact with said internal first thread of the pour spout and a barrier breaking portion configured to break the barrier of the container during the first opening.

The external second thread of the pour spout may occupy, in the axial direction z, a region located between a first plane and a second plane. The second plane may be arranged between the first plane and the second axial end of the pour spout. Further, the pivot axis of the hinge portion may be arranged in a third plane being located between the first plane and the second axial end of the neck portion.

When the lid portion is arranged in the first closed position the cap has a longitudinal centre axis corresponding to the longitudinal centre axis of the pour spout. The cap hence may comprise an axial extent, which includes the axial extents of both the annular longitudinal skirt and the retainment portion, extending between the first and second axial end of the pour spout.

The hinge portion may be arranged in a so-called raised position such that an axial extent of the retainment portion arranged below the hinge portion may be from 100% to 200% longer than the axial extent of the retainment portion arranged opposite the hinge portion in the circumferential direction, preferably from 100% to 150% longer. Further, the retainment portion may be dome shaped below the hinge portion.

Such raised hinge portion allows for easier opening and closing of the lid portion in that the lid portion easier arranges around the pour spout when being operated by a consumer. If the hinge portion is not raised the pour spout may serve as an obstacle hindering the lid portion to be arranged around the pour spout when operating the lid portion from the third to the second position.

The third plane may be arranged between the first and second planes or be arranged level or proximate the second plane or between the second plane and the second axial end of the neck portion. Further, the third plane of the pivot axis may be arranged parallel with the first plane $P_1$ and the second plane $P_2$.

The pour spout may further comprise a first and second retaining ring/bead ring. The first bead ring may be arranged between the flange portion and the second bead ring being configured to retain the annular tamper-evident band. The second bead ring may be arranged between the first bead ring and the second thread being configured to retain the retainment portion.

The axial distance between the first bead ring and the flange portion may define a first annular recess of the neck portion for receiving and retaining the tamper-evident band of the cap.

The tamper-evident band may extend annularly 360° around the pour spout when the closure device is assembled. Further, the first rupturable section may also extend annularly 360° around the pour spout. Hence, after twisting the cap a predetermined distance the pour spout, the first tamper-evident band may be fully separated from the retainment portion.

The first annular recess may comprise a plurality of ribs/axially arranged shoulders extending between the flange portion of the pour spout and the first bead ring.

Further, the tamper-evident band may comprise a plurality of bead sections extending radially towards the pour spout when the closure device is assembled. The bead sections may be separated by grooves.

Hence, when the closure device is assembled, the grooves of the tamper-evident band may abut the ribs of the pour spout thereby restricting the tamper-evident band from moving in the circumferential direction c when twisting the cap, during opening the closure device for the first time, causing the connecting bridges of the of the first rupturable section to break.

In an aspect of the invention the configuration of the tamper-evident band and the ribs may allow the lid portion to be twisted in the predetermined distance from any one of: the range of 5° to 60° or 25° to 50° or 30°, such as for example 45° in the circumferential direction c around the pour spout before the first rupturable section breaks disconnecting the tamper-evident band from the retainment portion.

The retainment portion may also be seen as a second tamper-evident band having two functions; the first being to retain the retainment portion of the cap about the pour spout after opening the closure device and the second being to indicate to a consumer if the closure device has previously been opened by providing tamper evidence. The retainment portion may prior to opening the closure device for the first time be connected to the annular skirt portion of the lid portion by connecting bridges arranged in the second rupturable section. The connecting bridges break the first time the closure device is being opened.

The second rupturable section may extend along the circumferential direction c between a first endpoint and second endpoint of the hinge portion. Hence, when the connecting bridges of the second rupturable section are broken, the lid portion is only connected to the retainment portion via the hinge portion.

The said predefined circumferential extent of the hinge portion may be within any one of: the range of 10° to 100°, 20° to 80° and 30° to 65°.

The second rupturable section may have a circumferential extent within any one of: the range of 260° to 350°, 280° to 340° and 295° to 330°.

Further the retainment portion may comprise an annular flexible band arranged on the inner surface of the retainment portion, hence facing the pour spout when the closure device is assembled. The flexible band may, before the cap has been assembled onto the pour spout of the closure device, have a radial extent bending downwards, i.e. towards the tamper-evident band. After the cap has been assembled onto the pour spout the flexible band is bended in the other direction, i.e. upwards such that the flexible band abuts the second bead ring of the pour spout. This allows the retainment portion to be freely oriented on the pour spout such that the lid-portion, when being in an open position, can be oriented away from the direction of the pouring of liquid from the pour spout, thereby providing an open position which does not interfere with the pouring operation.

The external second thread of the pour spout may comprise a first section and a second section. The first section may extend within any one of: the range of 250° to 340° or 280° to 330° and 290° to 320° in the circumferential direction c and may have a helix angle of 0°. The second section may extend within any one of: the range of 20° to 110° or 30° to 80° or 35° to 60° and 40° to 50° in the circumferential direction c and may have helix angle within any one of: the range of 5.0° to 20.0° or 6.0° to 9.0° and 14.0° to 16.0°, such as for example 15°.

The external thread may further comprise a third section extending within any one of: the range of 250° to 340° or 280° to 330° and 290° to 320° in the circumferential direction c and may have a helix angle of 0°.

Further, the external thread may comprise a fourth section extending within any one of: the range of 20° to 110° or 30° to 80° or 35° to 60° and 40° to 50° in the circumferential direction c and may have helix angle within any one of: the range of 5.0° to 20.0° or 6.0° to 9.0° and 14.0° to 16.0°, such as for example 15°. The fourth section may further be arranged parallel to and adjacent the second section.

The internal ramp of the lid portion of the cap may comprise a circumferential extent within any one of: the range of 20° to 70° or 30° to 60° and 40° to 60°, such as for example 50°.

Further, the internal ramp may have a helix angle being within any one of: the range of 5.0° to 10.0° or 6.0° to 9.0° and 7.0° to 8.0°.

According to another example aspect of the closure device, the first rupturable section is configured to rupture/break, i.e. the connecting bridges thereof break, before the barrier breaking element breaks the barrier of the container during opening of the closure device for first time.

Further, the second rupturable section may be configured to break after the barrier breaking element has broken the barrier of the container during opening of the closure device for first time.

The barrier breaking element may comprise breaking teeth separated by slits arranged between the teeth allowing liquid within the container to pass through the slits and into the pour spout after the barrier of the container has been broken. Each tooth may further have a tip arranged at a first axial end of the barrier breaking element. The tips being configured to interact and break the barrier of the container when opening the closure device 1 for the first time.

In another example aspect of the present invention the hinge portion may be arranged at the periphery of the annular skirt. The hinge portion may further comprise a tangential centre point that is arranged at a circumferential distance within any one of: the range of 150° to 180° or 170° to 180° and 175° to 180° from a tangential centre point of the ramp arranged on the inner surface of the annular skirt portion.

In a further aspect the axial extent of the retainment portion arranged below the hinge portion may be from 100% to 200% longer than the axial extent of the retainment portion arranged opposite the hinge portion, preferably from 100% to 150% longer. Further, the retainment portion may be dome shaped below the hinge portion.

The hinge portion may have a butterfly configuration comprising a pair of spaced trapezoidal ends spaced by a centre portion. The centre portion may have any shape such as e.g. a rectangular structure.

When flipping the lid portion from the second to the third position, the hinge portion may deform slightly thereby fixing the closure device in its third position. The butterfly hinge system may be adapted to bias the lid portion away from the circumferentially arranged retainment portion when the closure device is in the open position. Hence, the lid portion must be flipped back to the second position before the closure device can be rotated into the first position.

The term "flip" should be understood as an external force that is needed to be applied to the lid portion to move the lid portion between the second and third position.

In yet a further aspect of the closure device, the second axial end of the pour spout may comprise a sealing tongue extending towards the centre axis of pour spout. The sealing tongue may be oblique in the direction towards the first axial end of the pour spout.

Further, an end-wall of the lid portion of the cap may comprise an annular longitudinal bore seal having a common centre axis with the annular longitudinal skirt both extending in a same longitudinal direction and arranged such that the second axial end of the pour spout is arranged between the skirt and the bore seal when the lid portion is in the first position.

Further, the radial extent of the sealing tongue may be less than or equal the radial distance between inner surface of the annular longitudinal skirt and the bore seal of the lid portion providing liquid tight seal.

The bore seal may further have a gradually increasing longitudinal extent from a first point of the bore seal being proximate the hinge portion towards a second point of the bore seal being distal the hinge portion.

The bore seal may further contribute to guide and align the lid portion onto the pour spout when bringing the lid portion from the open/third position to the second position.

The disclosed embodiments of the closure device may be configured to be used in any liquid packaging container or container comprising a multi-ply paper or paperboard sheet on which may be laminated one or a plurality of barrier layers for holding liquid and/or prevent migration of air and flavour degrading substances through the paperboard. Such liquid packaging containers are commonly used for distributing dairy products, e.g. milk, or juices. Typically, closure devices for such applications are made from polyethylene and it is preferable that the disclosed closure device of the invention is made from this material.

The term "a first opening of the closure device" or "prior to opening the closure device for the first time" should be interpreted as being the arrangement of the closure device after assembling, e.g. that none of the first and second rupturable sections have been broken.

The term "first position of the lid portion" should be interpreted as the position just before the second rupturable section is broken, hence the position after the first rupturable section has been broken and after the barrier breaking element has broken the barrier and entered into the carton.

The present invention is also involving an assembly comprising a paper or paperboard-based container and a closure device, as disclosed in any one of the above-mentioned embodiments, fixed thereto.

Further, the present invention involves a method for providing a closure device disclosed in any one of the above-mentioned embodiments, wherein the method comprises the steps of:

providing a pour spout, providing a cap, providing a barrier breaking element and mounting said cap and barrier breaking element onto said pour spout.

The steps of providing the pour spout, cap and barrier breaking element may be performed by moulding.

Above-discussed preferred and/or optional features of each aspect may be used, alone or in appropriate combination, in the other aspects of the invention.

BRIEF DESCRIPTION OF THE DRAWINGS

Following drawings are appended to facilitate the understanding of the invention.

In the drawings, like reference numerals have been used to indicate like parts, elements or features unless otherwise explicitly stated or implicitly understood from the context.

DETAILED DESCRIPTION OF THE INVENTION

In the following, embodiments of the invention will be described in more detail with reference to the drawings. However, it is specifically intended that the invention is not limited to the embodiments and illustrations contained herein but includes modified forms of the embodiments including portions of the embodiments and combinations of elements of different embodiments as come within the scope of the following claims.

It is appreciated that certain features of the invention, which, for clarity, have been described above in the context of separate embodiments, may also be provided in combination in a single embodiment. Conversely, various features of the invention, which, for brevity, have been described in the context of a single embodiment, may also be provided separately or in any suitable sub-combination. In particular, it will be appreciated that features described in relation to one particular embodiment may be interchangeable with features described in relation to other embodiments.

Figure 1:
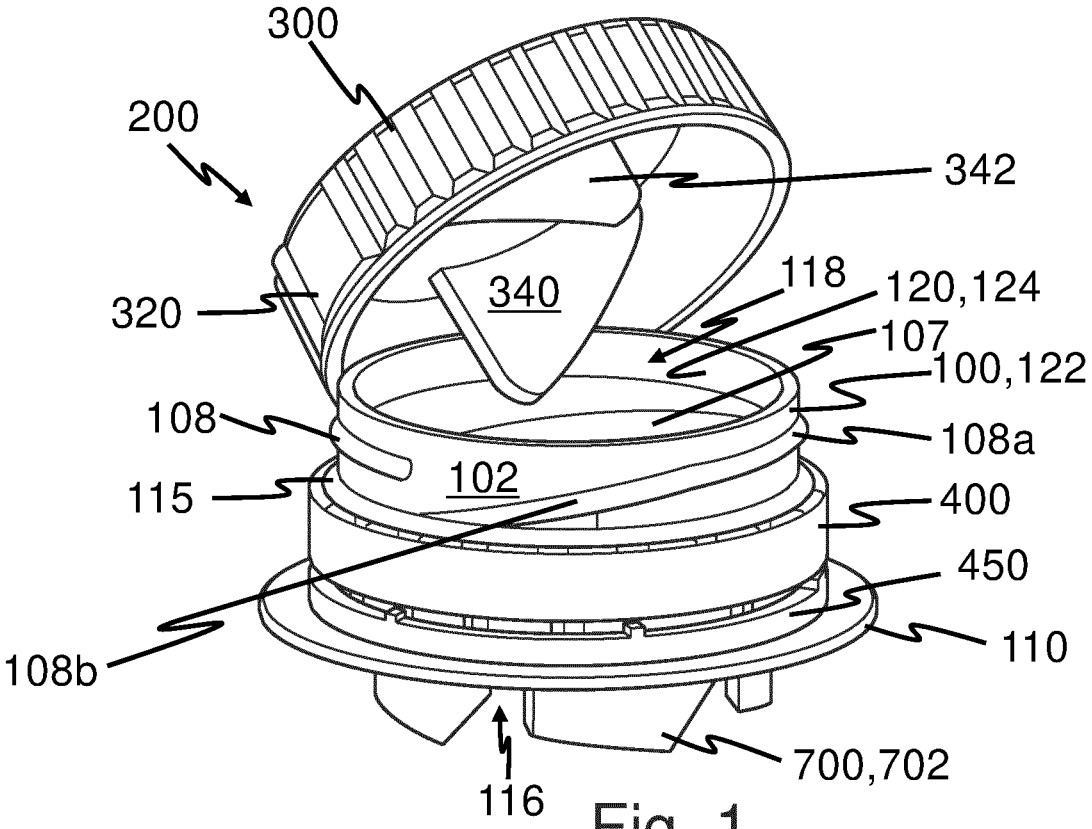
FIG. 1 is a perspective view of a closure device according to the invention wherein the lid portion is arranged between the second and third position.

FIG. 1 shows an example embodiment of the closure device 1 of the invention. The closure device 1 has three parts: a pour spout 100, a cap 200 and a barrier breaking element 700.

Figure 3A:
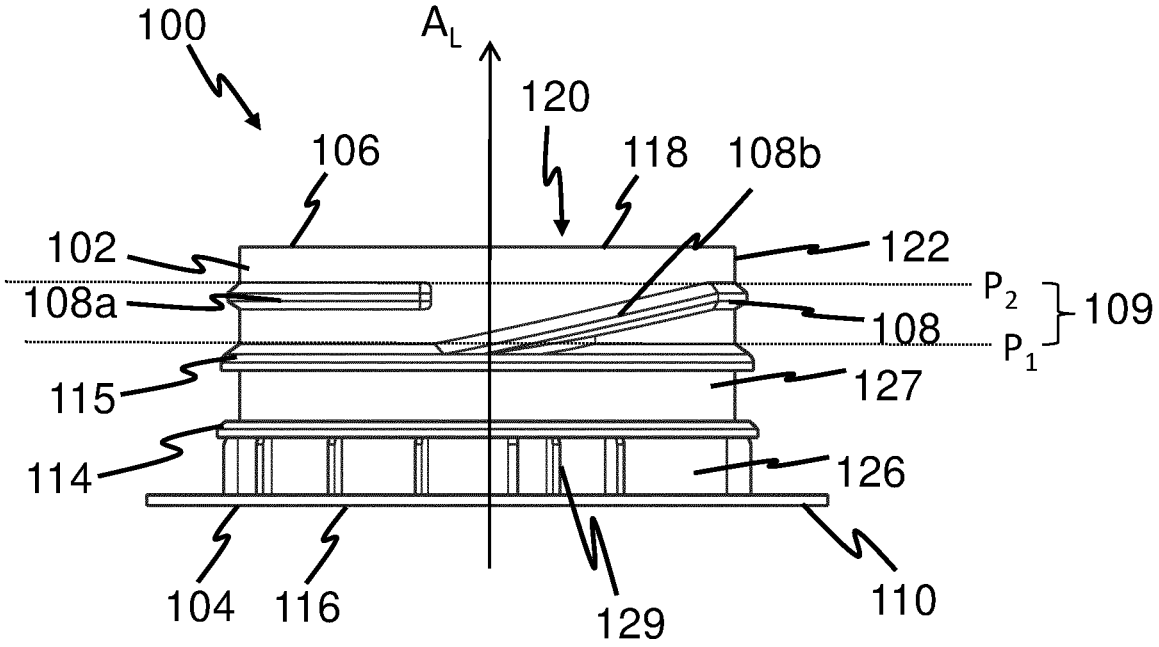
FIG. 3A is a side view of the pour spout according to a first example embodiment.
Figure 4:
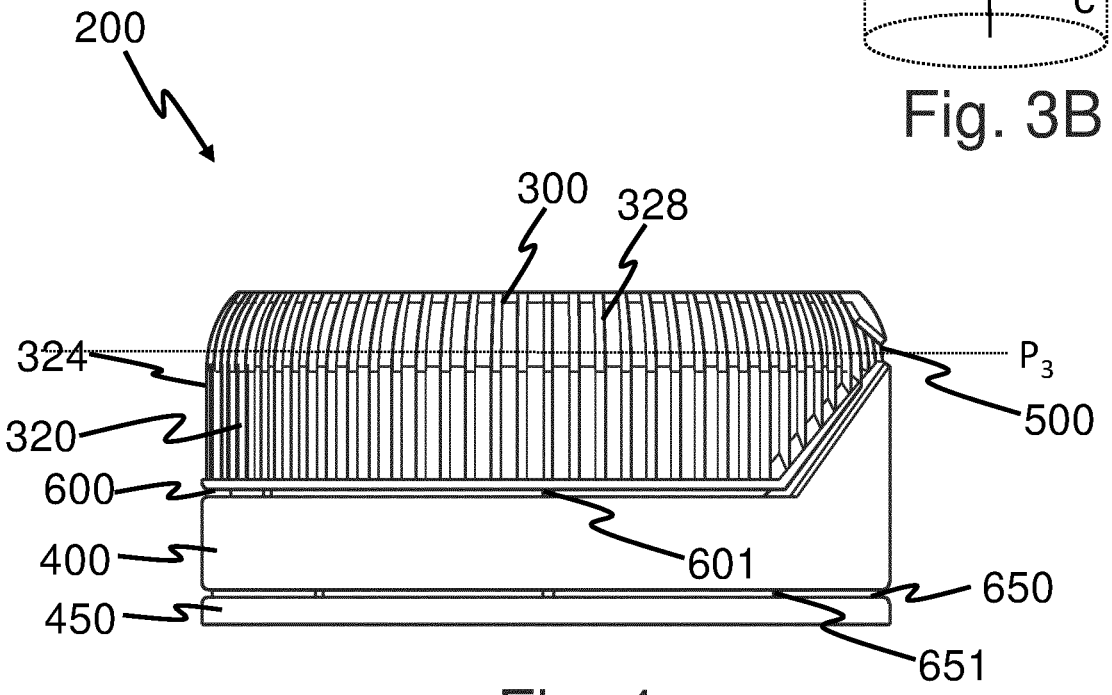
FIG. 4 is a side-view of the cap of the closure device.
Figure 5:
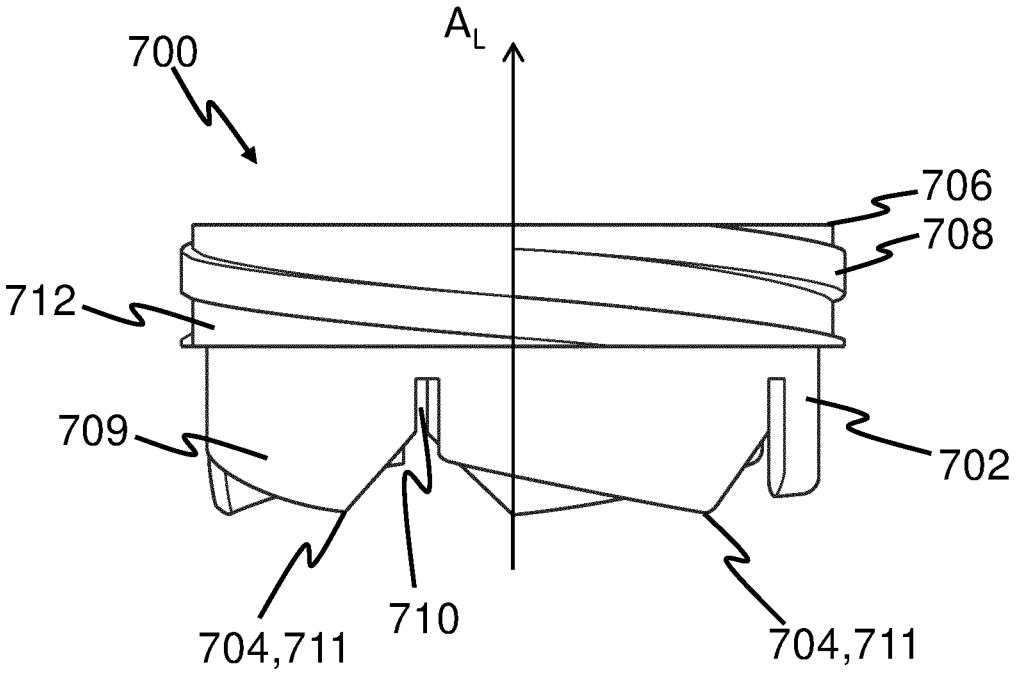
FIG. 5 is a side-view of the barrier breaking element of the closure device.
Figure 7:
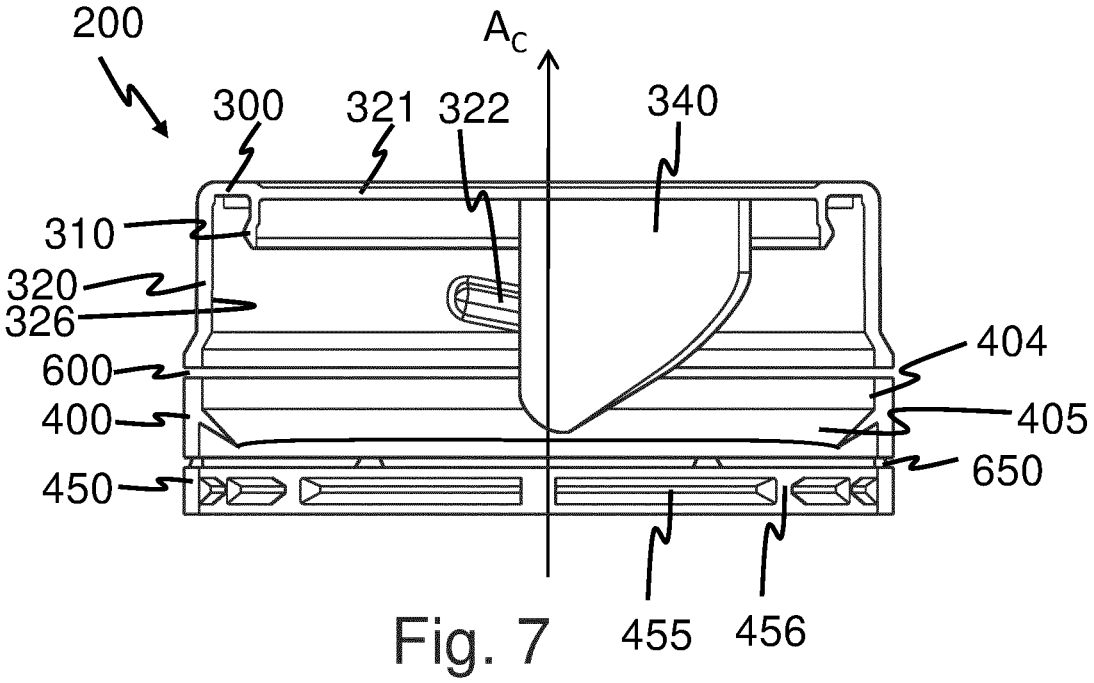
FIG. 7 is a cross-sectional side-view of the cap.
Figure 13:
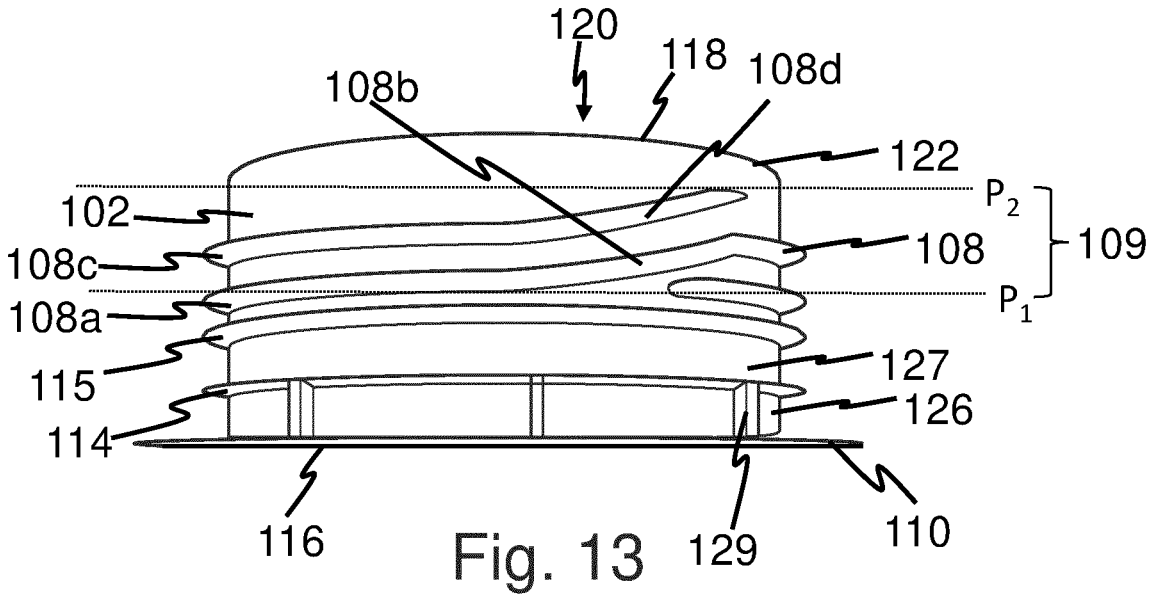
FIG. 13 is a side view of the pour spout according to a second example embodiment.
Figure 14:
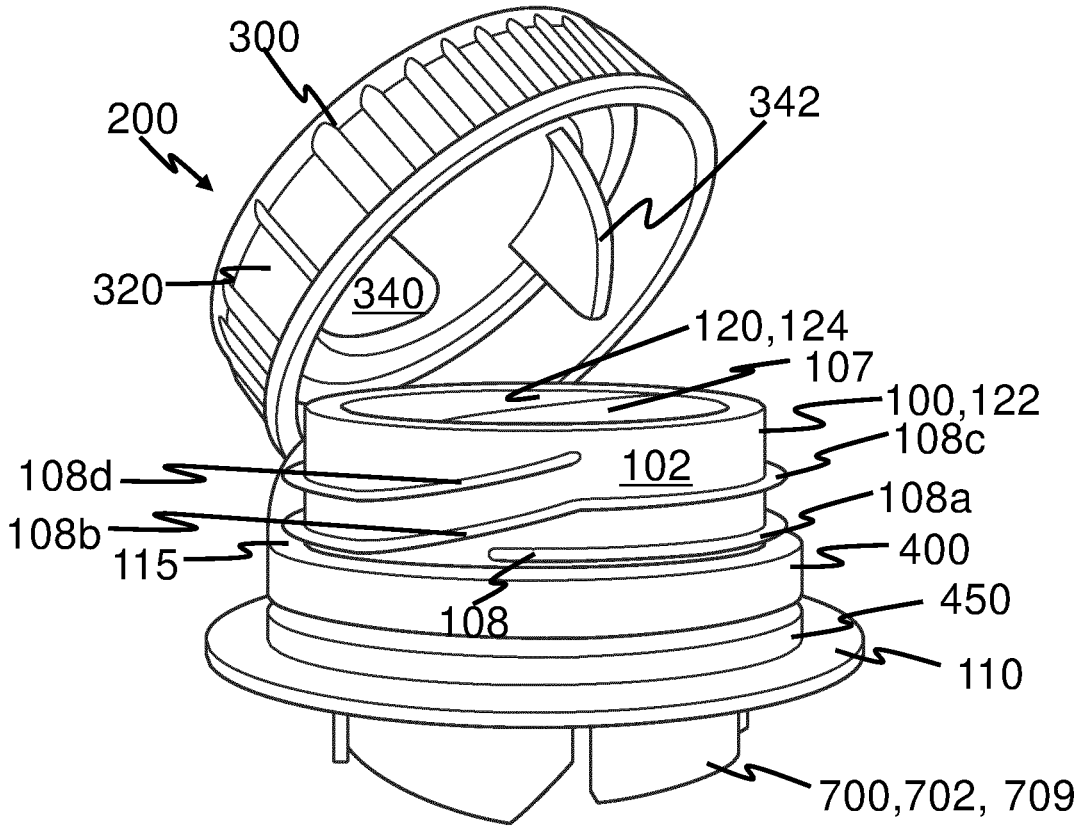
FIG. 14 is a perspective view of the closure device having a pour spout as shown in FIG. 13.

A first example embodiment of the pour spout 100 is shown in FIGS. 1, 3A and 8 and a second example embodiment of the pour spout is shown in FIGS. 13 and 14. FIGS. 4 and 7 show the cap 200 in detail and FIG. 5 shows the barrier breaking element 700 in detail.

Figure 3B:
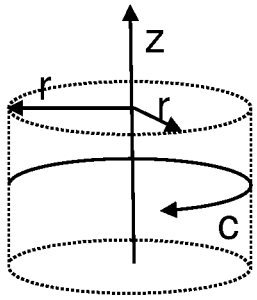
FIG. 3B is a geometric illustration of the annular longitudinal neck portion of a pour spout indicating the directions thereof.

With reference to FIGS. 1 and 3A, the pour spout 100 has an annular longitudinal neck portion 102 displaying an inner surface 124 and an outer surface 122. The neck portion 102 is extending in an axial direction z, see FIG. 3B, and the inner surface 124 forms a through-going channel 120 having a central axis $A_L$ arranged parallel with the axial direction z. The inner surface 124 is generally rotational-symmetric about the longitudinal central axis $A_L$ and defines a wall of the channel 120. The channel 120 forms a first base axial end 104 at a base of the pour spout 100 to a second top axial end 106 at a top of the pour spout 100. The first axial end 104 defines a first base opening 116 of the channel and the second top axial end displays a second top opening 118 forming a dispensing opening 118 of the pour spout 100.

For reasons of convenience, the description below considers that the terms "upwards" correspond to a axial longitudinal direction z that is generally parallel to the central axis $A_L$ of the pour spout 100 and that goes from the first opening 116 towards the second opening 118, whereas the terms and "downwards" correspond to the opposite direction. The terms "above"-"below", "top"-"base" and "upper"-"lower", correspond to relative positions with reference to these directions and the terms "inner"-"outer" correspond to relative positions with reference to a direction which is perpendicular to this direction.

At the first base end 104, the pour spout 100 displays an annular, radially and outwardly extending flange portion 110 configured to be fixed to a container which may be in the form of a paper or paperboard-based container/carton. The flange portion may for example be welded on to an outer surface of a carton at a location of the carton where a barrier of the carton can be readily broken by the barrier breaking element 700.

Both the inner surface 124 and the outer surface 122 of the pour spout 100 comprises a thread, i.e. an internal first thread 107 and an external second thread 108, respectively. The first thread 107 interacts with a third thread 708 arranged on the outer surface 712 of the barrier breaking element 700, see also FIG. 5. The second thread 108 of the pour spout 100 is interacting with the internal ramp 322 of the lid portion 300 of the cap 200 when opening and closing the closure device 1, see FIG. 7.

The second thread 108 displays a first section 108*a* and a second section 108*b*. The first section 108*a* extends about 300° in the circumferential direction c, see FIG. 3B, and has a helix angle of 0°. The second section 108*b* extends about 60° in the circumferential direction c and has a helix angle of 15°.

Further, the second thread 108 occupies, in the axial direction z, a region 109 located between a first plane $P_1$ and a second plane $P_2$. The first plane $P_1$ is arranged level with a second bead ring 115. The second plane $P_2$ is arranged between the first plane $P_1$ and the second axial end 106.

Figure 2:
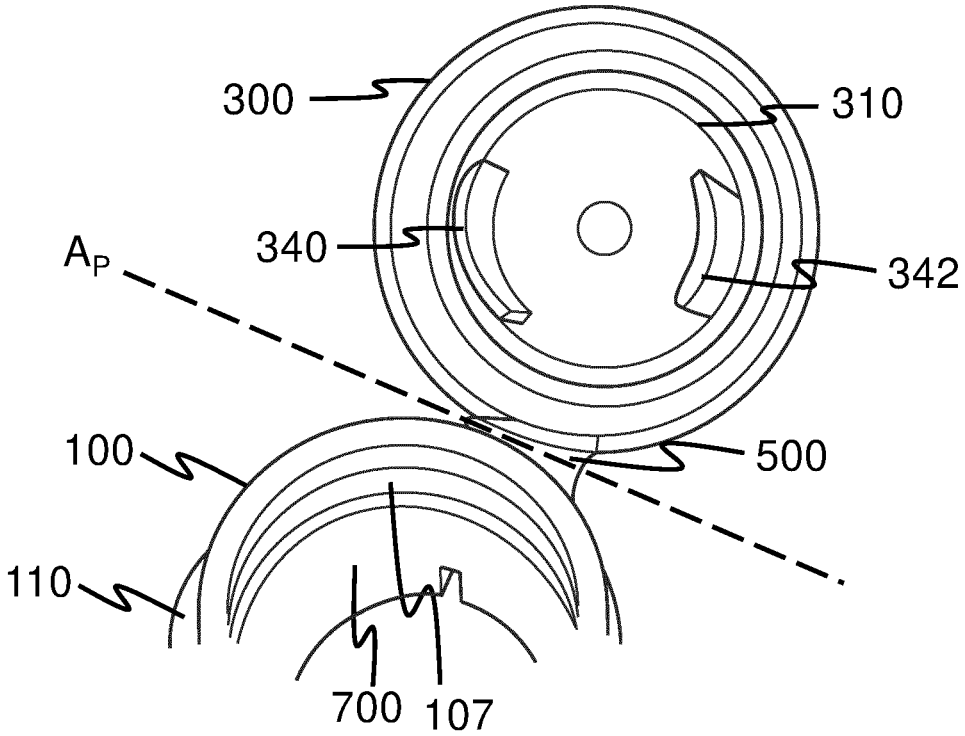
FIG. 2 is a perspective view of the same closure device as shown in FIG. 1 from a different angle wherein the lid portion is arranged in the third position.

As shown in FIG. 2 the hinge portion 500 of the cap 200 has as a pivot axis $A_P$ allowing the lid portion 300 to pivoted about said pivot axis $A_P$. The pivot axis $A_P$ is arranged at a third level $P_3$ which in FIG. 2 is level with the second level $P_2$. $P_3$ is illustrated in FIG. 4.

Figure 8A:
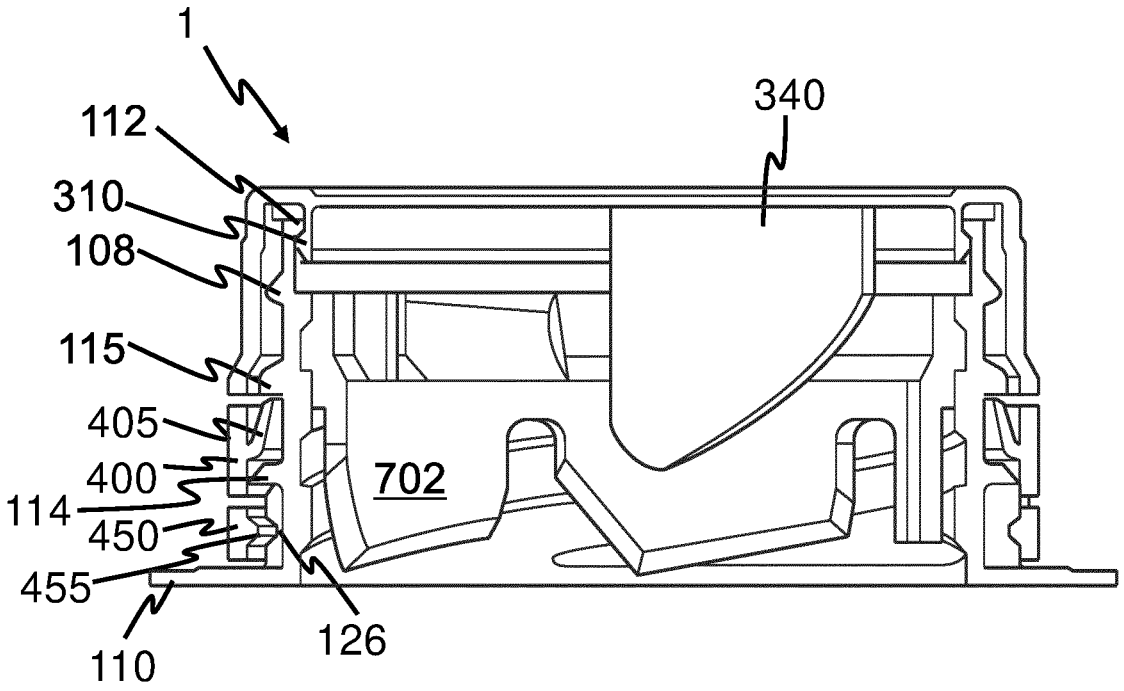
FIG. 8A is a cross-sectional side-view of the closure device when assembled prior to twisting the cap.

The pour spout 100 may have a sealing tongue 112 arranged at the second axial end 106, shown in FIG. 8A. The sealing tongue 112 may extend towards the longitudinal centre axis $A_L$ of the pour spout 100 in the radial direction r enhancing the sealing properties of the closure 1.

The sealing tongue 112 may further be oblique in the direction towards the first axial end of the pour spout.

The radial extent of the sealing tongue 112 may be less than or equal the radial distance between inner surface of the annular longitudinal skirt and a bore seal of a lid portion of the cap 200 which is described in further detail with regard to FIG. 7.

The first thread 107 has a helix angle of about 7°, even if the helix angle can be chosen to from 5° to 15°, and occupies in the axial direction the entire inner surface of the pour spout 100.

The outer surface 122 of the pour spout is provided with two axially displaced bead rings 114,115 referred to as the first bead ring 114 and the second bead ring 115. The first and second bead rings 114,115 are both annular and radially extending from the pour spout 100.

The first bead ring 114 is arranged between the second bead ring 115 and the flange portion 110 of the pour spout 100 and arranged at an axial distance, i.e. a distance in the axial direction z from both the second bead ring 115 and the flange portion 110.

The axial distance between the first bead ring 114 and the flange portion 110 defines a first annular recess 126 of the neck portion 102 for receiving and retaining a first tamper-evident band 450 of the cap 200. The annular recess 126 has a plurality of ribs 129 shown as axially arranged shoulders extending between the flange portion 110 and the first bead ring 114. Their function is discussed in more detail with regard to FIG. 8A.

Further, the axial distance between the first bead ring 114 and the second bead ring 115 defines a second annular recess 127 of the neck portion 102 for receiving and retaining a second tamper-evident band/retainment portion 400 of the cap.

Referring now to FIG. 1 and FIG. 4, the cap 200 of the closure device 1 comprises the first tamper-evident band 450 and the retainment portion 400, the lid portion 300 and a hinge portion 500 permanently connecting the lid portion 300 to the retainment portion 400.

The lid portion 300 is configured to seal the pour spout 100 when in closed position preventing fluid from passing therethrough. The lid portion 300 comprises an end wall 321 and an annular longitudinal skirt 320 extending from the circumference of the end wall 321. The longitudinal skirt 320 has one internal thread/ramp 322 which is configured to interact with the external thread 108 movably connecting the lid portion 300 of the cap 200 to the pour spout 100.

The annular skirt portion 320 has an outer surface 324 which comprises a plurality of parallel spines 328 for enhancing the grip of the consumer.

The retainment portion 400 of the cap 200 is circumferentially arranged around the neck portion 102 between the first tamper-evident band 450 and the lid portion 300 when the lid portion 300 is in a closed position.

The first tamper-evident band 450 is circumferentially retained between the first bead ring 114 and the flange portion 110 of the pour spout 100. Prior to opening the closure device 1 for the first time, the first tamper-evident band 450 is connected to the retainment portion 400 by a first rupturable section 650 arranged therebetween.

The first rupturable section 650 comprises a plurality of connecting bridges 651, which when opening the closure 1 for the first time will break such that first tamper-evident band 450 and the retainment portion 400 are physically separated.

The retainment portion 400 is connected to the lid portion 300 via a hinge portion 500 and a second rupturable section 600 via connecting bridges 601 before opening the closure device 1 for the first time. The hinge portion 500 is permanently connecting the lid portion 300 to the retainment portion 400 while the connecting bridges 601 of second rupturable section 600 will break during the first opening of the closure device 1 after the first rupturable section 650 has been broken. However, the hinge portion 500 is not broken during opening of the closure device 1 allowing the lid portion 300 to pivot around pivot axis $A_P$ of the hinge portion 500 after the second rupturable section 600 has been broken as shown in FIGS. 1 and 2.

When the closure device 1 is open and the liquid within the carton can be poured out, the lid portion 300 is pivoting away from the dispensing opening 118 such that the lid portion 300 is located at the side of the dispensing opening 118 of the pour spout 100. Hence, the lid portion 300 is moved away/flipped from the central axis $A_L$ of the pour spout 100 around the pivot axis $A_P$ sufficiently far to allow nearly unrestricted disposal of content through the dispensing opening 118 of the pour spout 100, as shown in FIG. 2.

The cap 200 is rotatable around the pour spout 100 due to the retainment portion 400 freely moving in the circumferential direction and hence allowing the consumer to move the lid portion 300 in the circumferential direction c such that it is not in the way during pouring.

Figure 6:
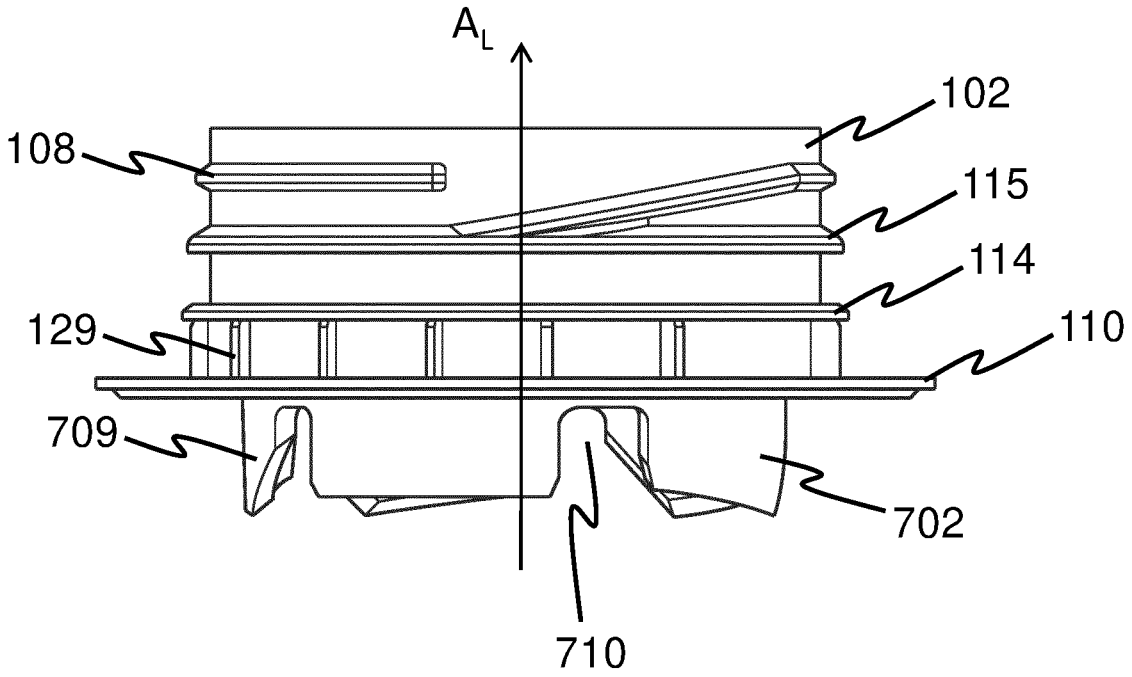
FIG. 6 is a side-view of the pour spout with the barrier breaking element therein.

FIG. 5 shows a detailed view of the barrier breaking element 700 which is configured to break a barrier of the carton onto which the closure device 1 is fixedly arranged. The element 700 generally has an open-ended cylindrical geometry to be arranged coaxially within the pour spout 100 as shown in FIG. 6. A barrier breaking portion 702 having a plurality of teeth 709 each having a tip 711 is arranged at a first axial end 704 of the element 700. The tips 711 interact and break the barrier of the carton when opening the closure device 1 for the first time.

As shown in FIG. 5 the element 700 has a third thread 708 arranged on the outer surface 712 which interacts with the first thread 107 of the pour spout 100 when opening the closure device 1 for the first time. The third thread 708 is arranged above the barrier breaking portion 702, occupying an area extending from a second axial end 706 to the barrier breaking portion 702. When the closure device 1 is assembled, hence prior to being opened for the first time, the second axial end 706 of the element 700 is arranged at or approximate the second axial end 106 of the pour spout 100, preferably abutting the sealing tongue of the pour spout 100, as shown in FIG. 8A. The element 700 is hence completely enclosed by the neck portion 102 of the pour spout 100 when assembled.

The first and third threads 107,708 have an helix angle such that when twisting the cap, hence when opening the closure for the first time, the element 700 is displaced/turned in the axial direction z and in the circumferential direction c towards the carton, i.e. away from the lid portion of the cap. The element 700 is turned due to an interaction with the cap that will be explained in further detail with reference to FIGS. 8C and 9C below. The turning of the element 700 about the central axils $A_L$ causes the tips 711 to move through the barrier of the carton by breaking/cutting off a segment of the barrier.

The tips 711 are preferably having a shape that does not dig into the barrier of the carton which can lead to torn off portions entering into the content of the carton, but instead cleanly cuts through a major segment the barrier by pushing a weakened area of the barrier.

Similar barrier breaking elements are known in the art from inter alia WO 2010/128302 A1 and U.S. Pat. No. 6,851,576 which are both incorporated herein by reference.

The weakened area of the barrier may for example include a partial-depth cut, i.e. a partially cut area that maintains the barrier properties until broken. The partial-depth cut may be a circular half-cut which the tips 711 of the tooth shaped barrier breaking portion 702 can interact with when turning the cap for the first time. Hence the tips 711 can ride on and push the circular half-cut portion of the barrier causing it to break. The tips 711 may travel a total of less than 360°, preferably around 300°, when interacting with the circular half-cut portion thereby making a through cut in the form of an open loop. Thereafter the barrier breaking portion 702 enters into the carton and pushes the barrier aside inwardly as shown in FIG. 5 of WO 2010/128302 A1 and FIG. 4 of U.S. Pat. No. 6,851,576.

To ensure that the tips 704 do not travel up to 360° in the circumferential direction ensuring that the barrier does not fall off and into the content of the carton, a segment/tooth 711 of the barrier breaking portion may not comprise a tip 704. The barrier breaking element 700 may further be arranged within the pour spout 100 such that said segment 711 pushes the barrier aside inwardly such that the barrier does not disrupt or block the liquid during pouring of liquid from the carton.

As shown in FIG. 5 the teeth 709 are separated by slits 710. The slits 710 are arranged between the teeth 709 to allow liquid within the carton to pass through the slits 710 and into the pour spout 100 after the barrier of the carton has been broken and hence when the barrier breaking portion 702 is arranged inside the carton. Hence, the slits 710 ensures that the liquid is not blocked by the barrier breaking portion 702 during pouring of liquid from the carton.

FIG. 7 is a cross sectional side-view of the cap 200 before being assembled to the pour spout 100. The lid portion 300 is open at its bottom end and closed at its top end by an end-wall 321 which at the outer periphery displays an annular longitudinal/tubular skirt 320 extending axially downwards, which annular longitudinal skirt 320 is centred on a central axis $A_C$ and has a circular base.

The inner surface 326 of the annular skirt 320 has the internal ramp 322 having a first tangential centre point which is about 170-180° from a tangential centre point of the hinge portion 500. The internal ramp further has an extent in the circumferential direction c of about 30°.

In the shown embodiment, the lid portion 300 is provided with an annular longitudinal bore seal 310 that extends axially downwards from the end-wall 321 in such a manner as to be centred on the central axis $A_C$ inside the longitudinal skirt 320. Hence, the annular longitudinal bore seal 310 is having a common centre axis with the annular longitudinal skirt 320.

Even if not shown, the bore seal 310 can have a gradually increasing longitudinal extent from a first point being proximate the hinge portion 500 towards a second point being distal the hinge portion 500. The longitudinal extent of the bore seal can be adapted to avoid any collision between the bore seal 310 and the sealing tongue of the pour spout when operating the lid portion 300 from third/open position towards the second position as further described below with regard to FIGS. 10, 11 and 12A to 12C.

It can be seen in FIG. 7 that the retainment portion 400 comprises an annular flexible band 405 extending downwardly, about 45°, at an inner surface 404 of the retainment portion 400 facing the pour spout 100 when assembled. The flexible band 405 is bended in the other direction to extend upwardly, about 45°, when assembling the closure device as shown in FIG. 8A.

As shown in FIG. 8A, the flexible band 405 abuts the second bead ring 115 of the pour spout 100 such that the retainment portion 400 is retained between the first and second bead rings 114,115. The retainment portion 400 may instead of the flexible band 405 have a plurality of flaps annularly arranged similar to the arrangement of the flexible band thereby having the same function.

The first tamper-evident band 450 has a plurality of bead sections 455 extending radially towards the pour spout when the closure device is assembled. The bead sections 455 are separated by grooves 456 shown in FIG. 7.

Figure 8B:
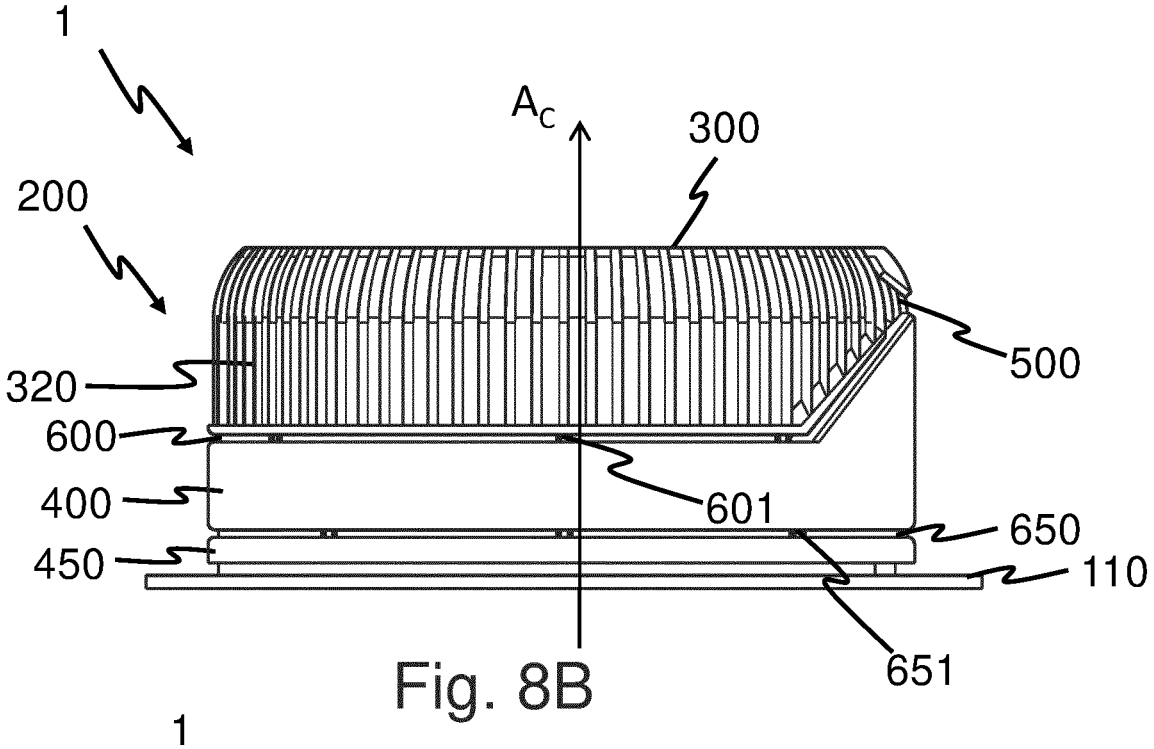
FIG. 8B is a side view of the closure device shown in FIG. 8A

When the closure device 1 is assembled as shown in FIG. 8A, the grooves 456 of the first tamper-evident band 450 abut the ribs 129 of the pour spout 100 restricting the first tamper-evident band 450 to move in the circumferential direction c when twisting the cap 200 during opening the closure device 1 for the first time. Hence the connecting bridges 651 of the first rupturable section 600 are broken when twisting the cap 200 for the first time, see also FIG. 8B showing the closure device 1 when assembled. The configuration of the grooves 456 of tamper-evident band 450 and the ribs 129 of the pour spout 100 allow the cap 200 to be twisted about 10 to 60° before first tamper-evident band 450 is restricted from moving, and hence before the connecting bridges 651 of the first rupturable section 650 are broken.

Figure 8C:
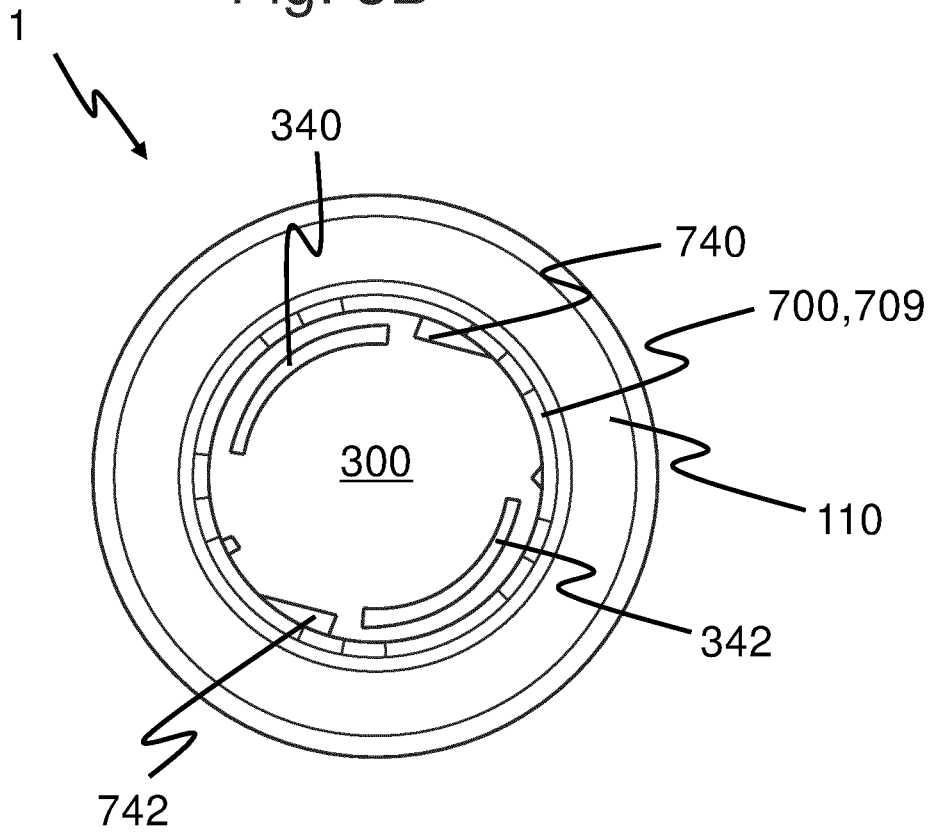
FIG. 8C is a bottom view of the closure device shown in FIGS. 8A and 8B.

FIG. 8C shows a bottom view of the assembled closure device 1, hence viewing the closure device 1 from the base opening 116 towards the top opening 118 being covered by the lid portion 300. The lid portion has two cams, referred to as a first cam 340 and a second cam 342, also shown in FIGS. 1, 2, 7 and 8A. The first and second cams 340,342 are configured to interact with the barrier breaking element 700 when opening the closure device 1 for the first time. The barrier breaking element displays a first and second protrusion 740,742 arranged to interact with the first and second cam 340,342 when opening the closure device 1 for the first time.

The first and second cam 340,342 arranged between the central axis $A_C$, see FIG. 8B of the lid portion 300 and the bore seal of the lid portion, and separated by about 180° in the circumferential direction c.

As seen in FIG. 8C the first cam 340 is arranged to abut the first protrusion 740 and the second cam 342 is arranged to abut the second protrusion 742 such that the teeth 709 of the barrier breaking element 700 can be moved out of the base opening 116.

However, when the closure device 1 is assembled there is no interaction between the first cam 340 and the first protrusion 740 or the second cam 342 and the second protrusion 742.

The interaction between the ribs 129 of the pour spout and the grooves 456 of the first tamper-evident band 450, discussed above, cause the connecting bridges 651 of the first rupturable section 650 to break before the first and second cams 340,342 interact with the first and second protrusions 740,742. This is to ensure any consumer that the closure device 1 has not been opened if the connecting bridges 651 of the first rupturable section 650 are not broken.

Figure 9A:
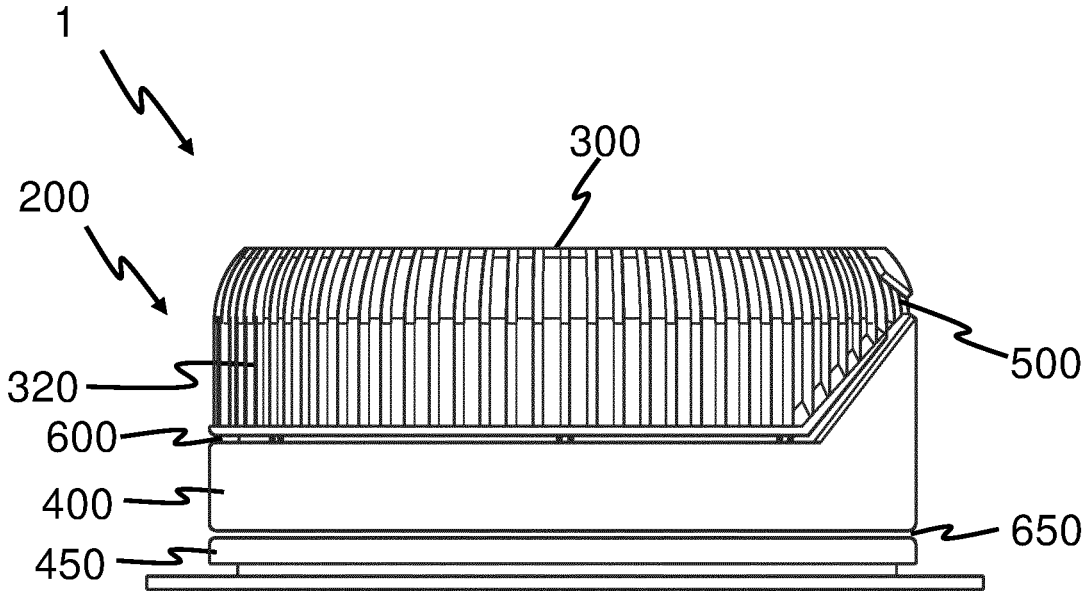
FIG. 9A is a side-view of the closure device after twisting the cap such that the first rupturable section has been broken.

FIG. 9A shows the closure device 1 after the connecting bridges 651 of the first rupturable section 650 have been broken. Hence, the rupturable section 650 provides, during the first opening, a clean break between the first tamper-evident band 450 and retainment portion 400. Once broken, the first rupturable section 650 provides evidence that the closure device 1 has been at least partly opened, thus providing so called "tamper evidence".

Figure 9B:
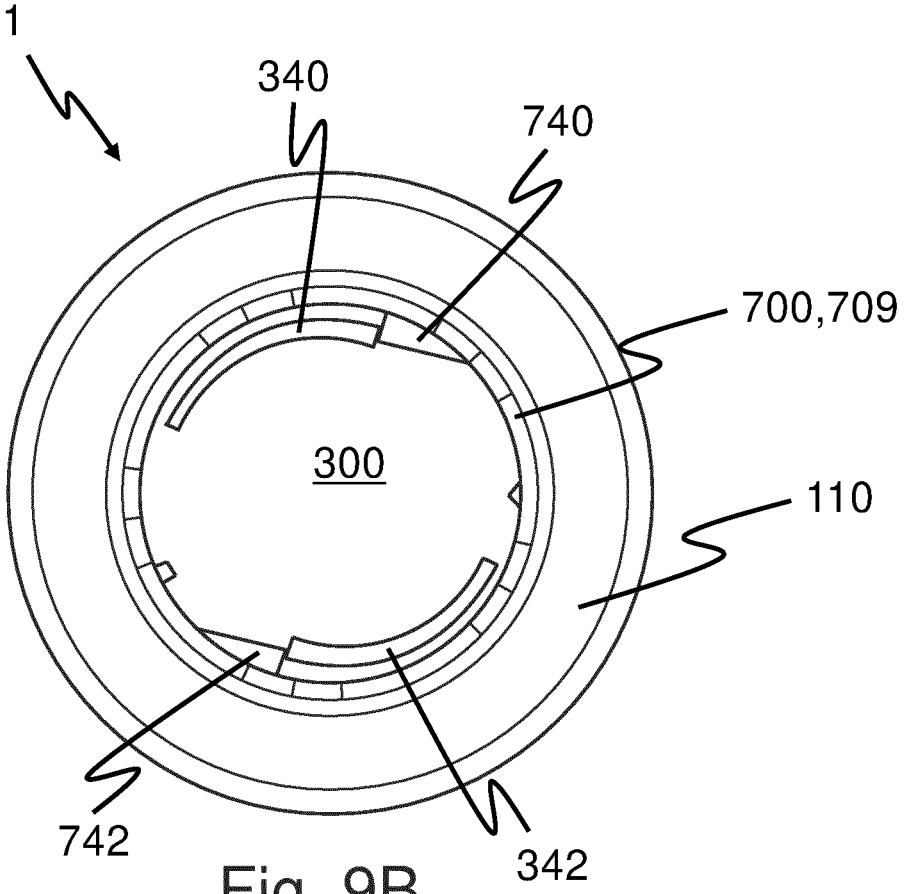
FIG. 9B is a bottom view of the closure device shown in FIG. 9A.

After the connecting bridges 651 of the first rupturable section 650 have been broken, the first and second cam 340,342 of the lid portion 300 engage with the first and second protrusions 740,742 of the element 700, respectively. This is shown in FIG. 9B showing the closure device 1 from the same view as FIG. 8C. By continuing twisting of the cap to open the closure device, the first and second cams 340,342 push the first and second protrusion 740,742 such that the element 700 is displaced in the axial direction z and in the circumferential direction c towards the carton. Due to the axial length of the first and second cam 340,342, and due to the configuration of the second threads 108 of the pour spout 100 interacting with the ramp 322 of the lid portion 300, the element 700 will be pushed in the circumferential direction c a length corresponding to the length of the first section 108*a* of the second thread 108, hence approximately 300°.

Figure 10:
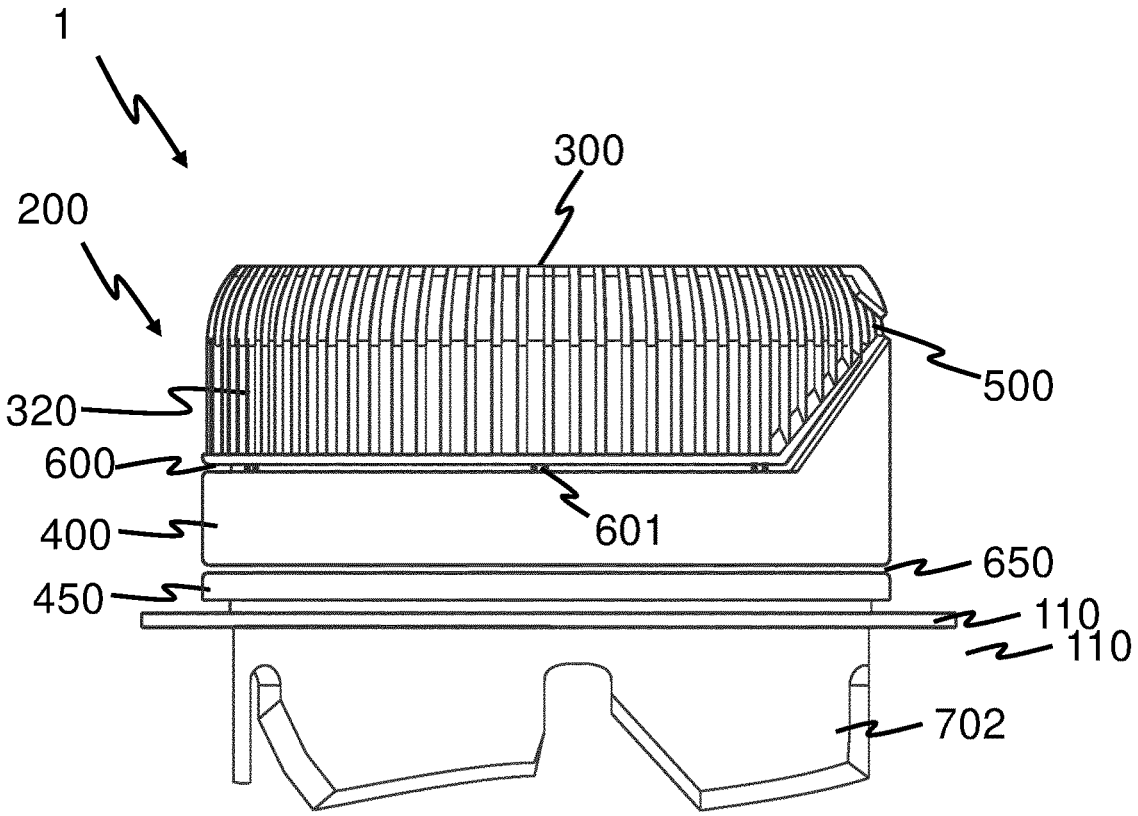
FIG. 10 is a perspective view of the closure device after twisting the cap until the barrier breaking element has broken the barrier of the container.

FIG. 10 illustrates the closure device 1 after twisting the cap 200 for approximately 300° after the first and second cam 340,342 have engaged with the first and second protrusions 740,742, hence showing that the barrier breaking portion 702 protrudes out of the first base opening of the pour spout 100, hence the barrier of the carton has been broken and the barrier breaking portion 702 has entered into the carton. Further, it is shown that the connecting bridges 651 of the first rupturable section 650 have been broken, while the connecting bridges 601 of the second rupturable section 600 are still intact. When the lid portion 300 is still connected to the retainment portion 400 in this position, the lid portion 300 is referred to as being in the first position $P_F$.

Figure 11:
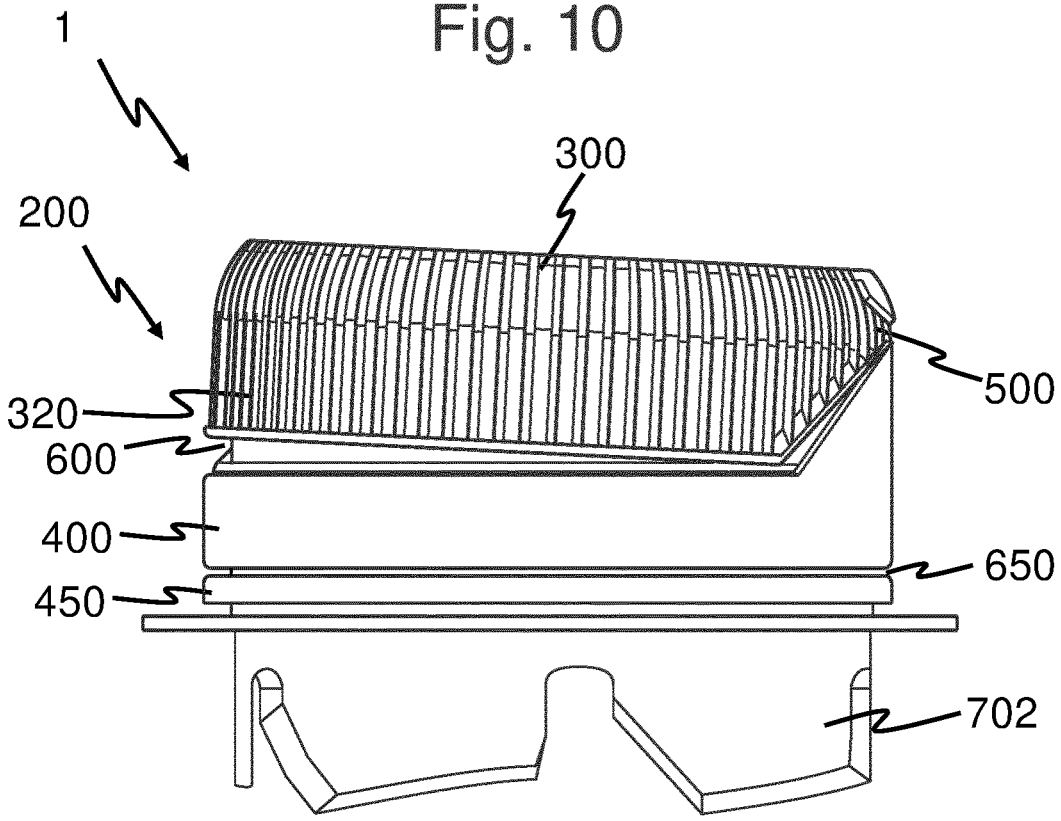
FIG. 11 is a perspective view of the closure device after twisting the cap until after the second rupturable section has been broken.

FIG. 11 illustrates the closure device 1 after continuing twisting the cap 200 for opening the lid portion 300 of the closure device 1. Due to the configuration of the second threads 108 of the pour spout 100 interacting with the ramp 322 of the lid portion 300, the lid portion 300 of the cap has been pushed in the circumferential direction c and upwards in the axial direction z a length corresponding to the length of the second section 108*b* of the second thread 108, being approximately 60°. Hence, the connecting bridges 601 of the second rupturable section 600 are broken since the retainment portion 400 is retained by the second bead ring. The lid portion 300 is now ready to be flipped about the pivot axis $A_P$ shown disclosed in FIGS. 1, 2, 12B and 12C due to the hinge portion 500 fixing the lid portion 300 to the retainment portion 400. In this position, the lid portion 300 is referred to as being in a second position $P_S$.

The second rupturable section 600 provides, during the first opening, a clean break between the retainment portion 400 and the part of the lid portion 300 that is not hinged to the retainment portion 400. Once broken, the rupturable section 600 provides evidence that the closure device 1 has been fully opened, thus providing tamper evidence.

Figure 12A:
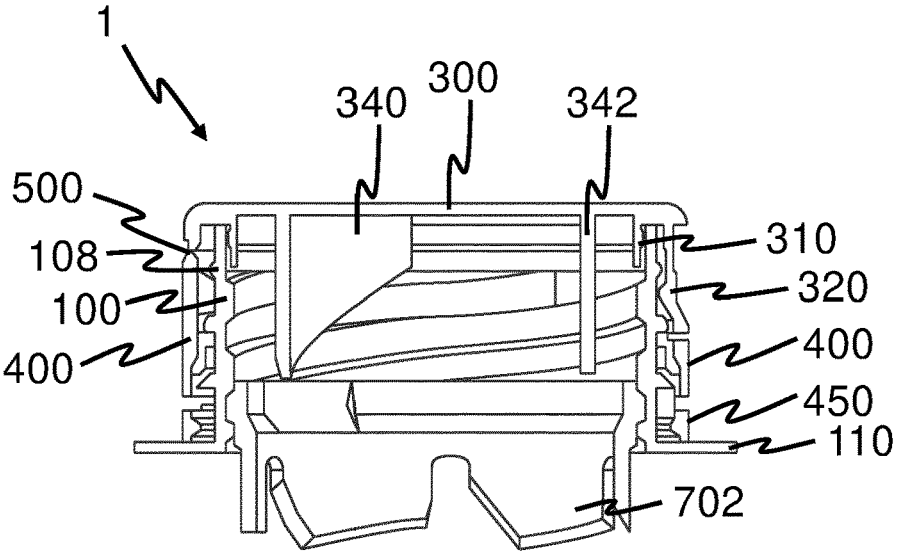
FIG. 12A is a cross sectional view of the closure device in FIG. 10.
Figure 12B:
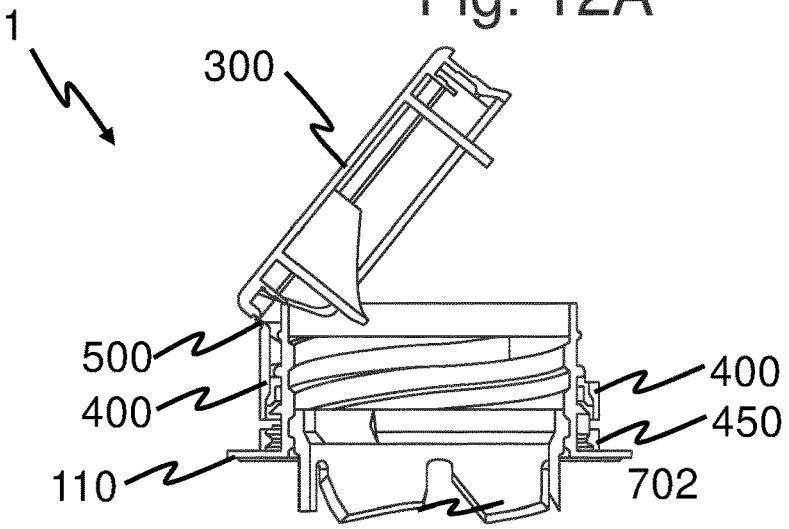
FIG. 12B is a cross sectional view of the closure device after twisting the cap until the barrier breaking element has broken the barrier of the container and wherein the lid portion has been flipped to an intermediate position between the second and third position.
Figure 12C:
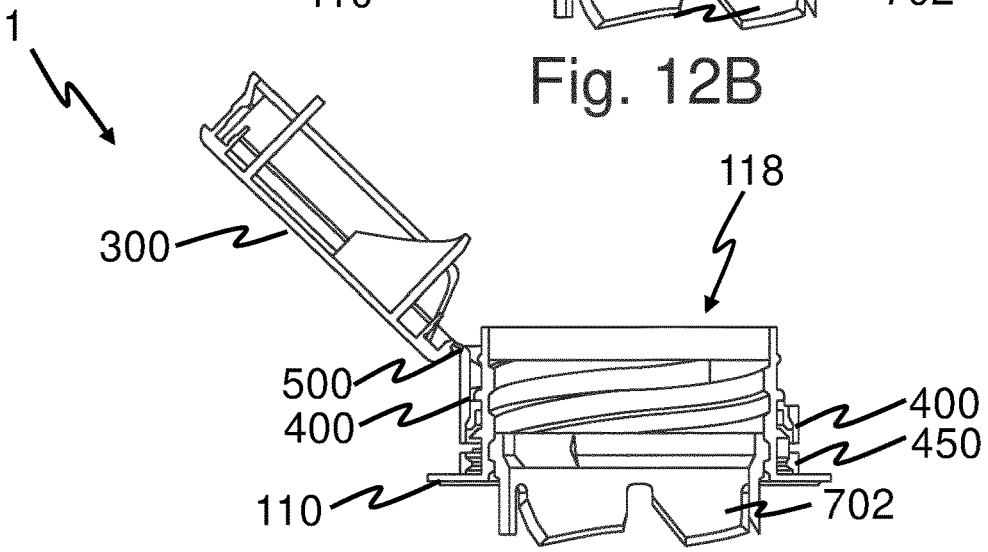
FIG. 12C is a cross sectional view of the closure device where the lid portion has been flipped to the third position for pouring out the liquid from the container.

FIGS. 12A to 12C illustrate the flipping operation of the lid portion 300 all showing cross-sectional side views of the same closure device 1.

In FIG. 12A the cap 200 has already been twisted along the first section 108*a* of the second thread 108, and hence the barrier breaking portion 702 of the barrier breaking element 700 has been moved into the carton. The connecting bridges of the second rupturable section 600 are hence ready to be broken, thus the configuration of the closure device is the same as disclosed in FIG. 10. Hence the lid portion 300 is arranged in the first position $P_F$.

In FIG. 12B the lid portion 300 has been separated from the retainment portion 400 along the second rupturable section but is fixed to retainment portion 400 by a hinge portion 500. The lid portion 300 has further been partly flipped to an intermediate position between the second position $P_S$ and a third position/dispensing position $P_T$ shown in FIG. 12C. Hence FIG. 12B illustrates the same position of lid portion as shown FIG. 1.

FIG. 12C shows the lid portion arranged at the third position $P_T$ allowing the content of the carton the be readily poured out through the dispensing opening of the pour spout 100, as also illustrated in FIG. 2.

Figure 15:
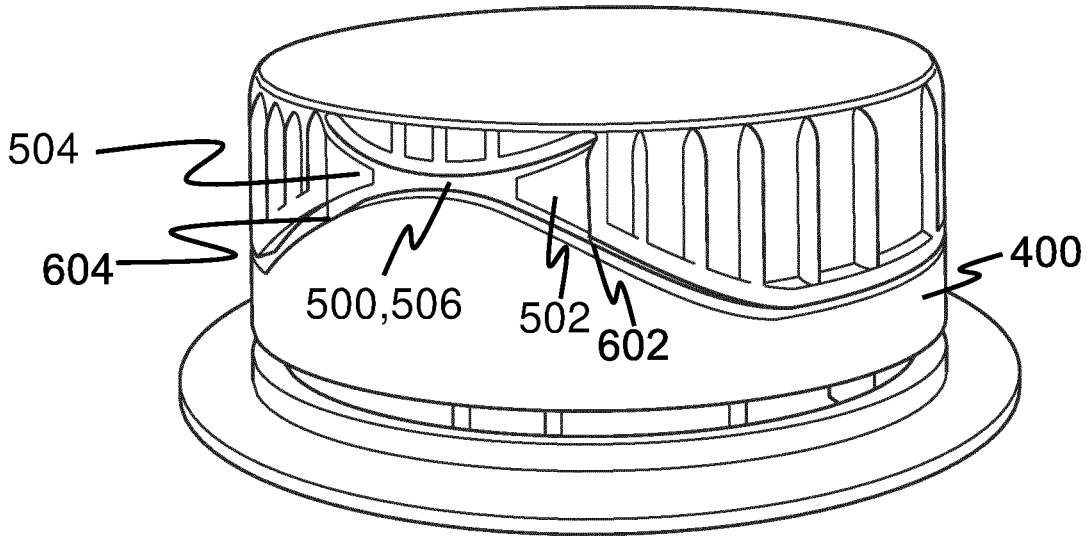
FIG. 15 is a perspective view of the closure device showing an example embodiment of the hinge portion.

As shown in FIGS. 12A to 12C, the retainment portion 400 has a longer axial extent where the hinge portion 500 is fixed to the retainment portion 400, compared to the other side of the retainment portion 400 from which the content of the container can be poured out from the closure device 1. This way the hinge portion 500 is heightened, which is also illustrated in FIG. 15. The axial extend of the retainment portion is about 120% longer than the length axial extent of the retainment portion 400 arranged opposite the hinge portion 500.

FIG. 13 shows a pour spout 100 according to a second example embodiment of the invention and FIG. 14 shows the pour spout 100 arranged within a closure device 1. The only difference between the first and second example embodiments of the pour spout 100 is the configuration of the threads, hence the remaining parts of the pour spout are as disclosed for the first example embodiment and will hence not be repeated for the second example embodiment.

The second thread 108 displays a first section 108*a*, a second section 108*b*, a third section 108*c* and a fourth section 108*d*. The first section 108*a* extends about 330° in the circumferential direction c and has a helix angle of 0°. The second section 108*b* extends about 60° in the circumferential direction c and has a helix angle of about 15°. The third section 108*c* extends about 300° in the circumferential direction c and has a helix angle of 0° and the fourth section 108*d* extends about 60° in the circumferential direction c and has a helix angle of about 15°.

The first and third sections 108*a*,108*c* are arranged parallelly next to each other being displaced in the axial direction z for allowing the ramp of the lid portion to interact with the first and/or third sections 108*a*,108*c* of the second thread 108 when twisting the cap.

The second section 108*b* and the fourth section 108*d* are arranged parallelly and next to each other being displaced in the axial direction z also for allowing the ramp of the lid portion to interact with the second and/or fourth section 108*b*,108*d* when twisting the cap.

The second thread 108 occupies in the axial direction z, a region 109 located between a first plane $P_1$ and a second plane $P_2$. The first plane $P_1$ is arranged adjacent and above the second bead ring 115. The second plane $P_2$ is arranged between the first plane $P_1$ and the second axial end 106.

As seen in FIG. 14 the assembling of the closure device is the same as shown for the first example embodiment of the pour spout in FIG. 1.

FIG. 15 shows an example embodiment of the hinge portion 500 having a butterfly hinge system comprising a pair of spaced trapezoidal ends 502, 504 spaced by a centre portion 506, the centre portion 506 having a rectangular shape which may have bended longitudinal edges. The butterfly hinge system is adapted to bias the lid portion 300 away from the circumferentially arranged retainment portion 400 when the closure device 1 is in the open position as shown in FIG. 2.

FIG. 15 further illustrate end points 602,604 of the rupturable section 600 which are separated by the hinge portion 500. It can be seen that the circumferential extent of the retainment portion 400 below the hinge portion 500 displays a curved shape extending upwards towards the hinge portion 500, such that the retainment portion 400 is dome shaped below the hinge portion 500. The dome shaped area of the retainment portion 400 can have a circumferential extent in the circumferential direction c from about 30° to 100° of the total circumference of the retainment portion 400.

The retainment portion 400 may however have other shapes than the shown dome shaped structure below the hinge portion enabling the pivot axis $A_P$ to be arranged at the third plane $P_3$ being between the first level $P_1$ and the second axial end of the pour spout 100.

Generally, with respect to FIGS. 1 to 15 the lid portion 300 is re-sealably arranged on the pour spout 100. The ramp 322, see FIG. 7, of the lid portion 300 is configured to interact with the external thread 108 of the pour spout 100, allowing the lid portion 300 to be rotated/twisted about the central axis $A_L$ of the pour spout 100 and to be twisted/screwed off the pour spout 100 bringing the closure device 1 from a first/closed position, see FIG. 10, to a second position which lid portion 300 non-sealingly covers the dispensing opening 118, see FIG. 11, and twisted on to the pour spout 100 bringing the closure device 1 from said second position to the first/closed position.

In the second position the central axis $A_C$ of the annular longitudinal skirt 320 of the lid portion 300 is different from the longitudinal centre axis $A_L$ of the pour spout 100.

When the closure device 1 is moved from the first/closed position to second position, the lid portion 300 is rotated until the ramp 322 is released into a non-interacting position with the external thread 108 such that the lid portion 300 can be moved away from the pour spout 100 into the third position by flipping/pivoting the lid portion 300 about pivot axis $A_P$ of the hinge portion 500 allowing content, e.g. a liquid, to be dispensed through the dispersing opening 118 of the pour spout 100, see FIGS. 2 and 12C.

Figure 16:
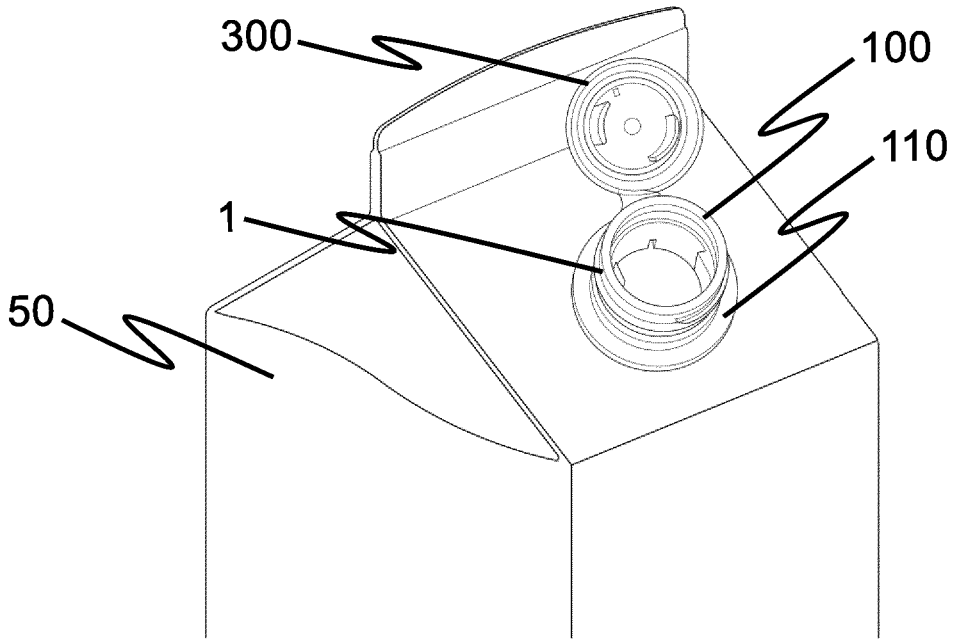
FIG. 16 is a perspective view of a part of a container/carton with the closure device fixed thereto.

FIG. 16 shows an example of a carton 50 comprising the closure device 1 where the lid portion 300 is in an open third position. As can be seen the flange portion 110 of the pour spout 100 has been fixed the outer surface of the carton 50, which can be done by e.g. hot air or ultrasonic welding.

With reference to all the drawings, the following sequential steps allow a user to open the closure device 1 from the assembled position to the third/open position:

a) providing the closure device 1 in a closed assembled position, b) rotating/twisting the lid portion 300 of the cap 200 about 45° in an anti-clockwise direction having a helix angle of 0° until the connecting bridges 651 of the first tamper-evident band 650 are broken.

c) rotating the lid portion 300 further about 300° at a helix angle of 0° until the barrier breaking element 700 has broken the barrier of the carton 50 and the barrier breaking portion 702 has been permanently arranged inside the carton 50, hence arranging the lid portion 300 in a first position $P_F$.

d) continue rotating the lid portion towards the second position $P_S$ about 60° such that the second section 108*b* of the external thread 108 and the internal ramp 322 force the lid portion 300 to be separated from the retainment portion 400 along the second rupturable section 600, hence breaking the connecting bridges 601, and then c) flipping the lid portion 300 about pivot axis $A_P$ into the third position $P_T$ such that the dispensing opening 118 of the pour spout 100 is open for dispensing liquid from the carton 50.

Further, the following steps allow the user to close the closure device 1 from when starting from the third/open position.

d) flipping the lid portion 300 back onto the pour spout 100 into the second position $P_S$, e) rotating the cap 200 in the clockwise direction until making the closure device 1 liquid tight.

The invention claimed is:

1. A closure device for being attached to a closed aseptic paper or paperboard-based container at a location wherein a barrier of the container can be readily broken, the closure device comprising three parts, a pour spout, a cap and a barrier breaking element, wherein the pour spout comprises:

a longitudinal center axis defining an axial direction, a circumferential direction and a radial direction of the pour spout;

an annular longitudinal neck portion extending along the axial direction from a first axial end to a second axial end defining a dispensing opening, the neck portion further comprising an internal first thread for interacting with the barrier breaking element and an external second thread for interacting with the cap;

an annular flange portion for attaching the closure device to the container, the annular flange portion extending in the radial direction outwardly from the second axial end of the neck portion;

the cap comprises:

an annular tamper-evident band being retained around said neck portion;

a retainment portion being rotatably retained around said neck portion, a lid portion comprising an annular longitudinal skirt having an internal ramp configured to interact with said external second thread of the pour spout;

a hinge portion having a pivot axis about which the lid portion is configured to be pivotally movable relative to the retainment portion, the hinge portion permanently connecting the annular skirt of the lid portion to the retainment portion along a predefined circumferential extent;

a first rupturable section along which the tamper-evident band is configured to be connected to the retainment portion prior to a first opening of the closure device, the first rupturable section being configured to break during the first opening;

a second rupturable section along which the lid portion is configured to be connected to the retainment portion prior to the first opening, which second rupturable section is configured to break during the first opening;

wherein the lid portion is configured to be operable between a first position in which the lid portion sealingly covers said dispensing opening, a second position in which the lid portion non-sealingly covers the dispensing opening, and a third position in which the lid portion is located at least partly at a side of the dispensing opening;

the barrier breaking element comprises:

an external third thread configured to interact with said internal first thread of the pour spout; and a barrier breaking portion configured to break the barrier of the container during the first opening.

2. The closure device according to claim 1, wherein the external second thread of the pour spout occupies, in the axial direction, a region located between a first plane and a second plane, wherein the second plane is arranged between the first plane and the second axial end and wherein the pivot axis of the hinge portion is arranged in third plane being located between the first plane and the second axial end of the neck portion.

3. The closure device according to claim 2, wherein the third plane is arranged level with the second plane, proximate the second plane or between the first and second planes.

4. The closure device according to claim 1, wherein the pour spout further comprises a first bead ring and a second bead ring, the first bead ring being arranged between the annular flange portion and the second bead ring, and the second bead ring being arranged between the first bead ring and the second thread.

5. The closure device according claim 1, wherein said first rupturable section extends annularly 360° around the pour spout.

6. The closure device according to claim 1, wherein said second rupturable section extends along the circumferential direction between a first endpoint and second endpoint of the hinge portion.

7. The closure device according to claim 1, wherein the external second thread comprises a first section and a second section, wherein the first section extends within any one of: the range of 250° to 340° or 280° to 330° and 290° to 320° in the circumferential direction having a helix angle of 0°, and the second section extends within any one of: the range of 20° to 110° or 30° to 80° or 35° to 60° and 40° to 50° in the circumferential direction having a helix angle within any one of: the range of 5.0° to 20.0° or 6.0° to 9.0° and 14.0° to 16.0°.

8. The closure device according to claim 1, wherein the internal ramp comprises a circumferential extent within any one of: the range of 20° to 70° or 30° to 60° and 40° to 60°.

9. The closure device according to claim 1, wherein the internal ramp has a helix angle being within any one of: the range of 5.0° to 15.0° or 6.0° to 9.0° and 7.0° to 8.0°.

10. The closure device according to claim 1, wherein the first rupturable section is configured to rupture before the barrier breaking portion breaks the barrier of the container when twisting the lid portion for the very first time.

11. The closure device according to claim 1, wherein the hinge portion is arranged at the periphery of the annular skirt and comprises a tangential center point, and the internal ramp comprises a tangential center point arranged at a circumferential distance within any one of: the range of 150° to 180° or 170° to 180° and 175° to 180° from the tangential center point of the hinge portion.

12. The closure device according to claim 1, wherein the second axial end of the pour spout comprises a sealing tongue extending towards the center axis of pour spout.

13. The closure device according to claim 12, wherein the sealing tongue is oblique in the direction towards the first axial end of the pour spout.

14. The closure device according to claim 1, wherein an end-wall of the lid portion comprises an annular longitudinal bore seal having a common center axis with the annular longitudinal skirt both extending in a same longitudinal direction and arranged such that the second axial end of the pour spout is arranged between the skirt and the bore seal when the lid portion is in the first position.

15. An assembly comprising a paper or paperboard-based container and a closure device according to claim 1.

16. A method for providing a closure device according to claim 1 wherein the method comprises the steps of:

providing a pour spout, providing a cap providing a barrier breaking element mounting said cap and barrier breaking element onto said pour spout.

17. The method according to claim 16, wherein the steps of providing said pour spout, cap and barrier breaking element are performed by moulding.

* * * * *